US006638673B2

(12) United States Patent
Dartnell et al.

(10) Patent No.: US 6,638,673 B2
(45) Date of Patent: Oct. 28, 2003

(54) METHOD AND SYSTEM FOR CALCULATING THE FRACTIONAL EXPOSURE OF PHOTOGRAPHIC MATERIAL

(75) Inventors: Nicholas J. Dartnell, Watford (GB); Christopher B. Rider, New Malden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/144,632

(22) Filed: May 13, 2002

(65) Prior Publication Data

US 2003/0028277 A1 Feb. 6, 2003

(30) Foreign Application Priority Data

May 18, 2001 (GB) ..... 0112108

(51) Int. Cl.[7] ..... G03C 5/00
(52) U.S. Cl. ..... 430/30
(58) Field of Search ..... 430/30

(56) References Cited

U.S. PATENT DOCUMENTS 3,828,172 A 8/1974 Schickler ..... 235/151.12
3,970,475 A 7/1976 Gerbier et al. ..... 136/100 R
4,314,753 A 2/1982 Kaufmann ..... 354/321

FOREIGN PATENT DOCUMENTS

EP 0 610 561 A 8/1994
EP 0 742 482 A 11/1996
EP 0 872 764 A 10/1998
GB 2 111 726 A 7/1983

*Primary Examiner*—Hoa Van Le
(74) *Attorney, Agent, or Firm*—Milton S. Sales

(57) ABSTRACT

The invention provides a method for calculating the fractional exposure of black and white photographic material, the developed material being processed in a processing system having a fixing stage and an in-line silver recovery unit associated with the fixing stage, comprising the steps of determining the mass of silver recovered by the in-line silver recovery unit during a period of operation of the method, calculating a first estimate for the fractional exposure of the photographic material in dependence on the determined mass of silver and, using said first estimate as an input to an iterative process, to calculate a subsequent estimate for the fractional exposure (θ) of the photographic material. The invention provides a simple and accurate method and system for calculating the fractional exposure of photographic material without requiring the use of a silver sensor.

14 Claims, 6 Drawing Sheets

METHOD AND SYSTEM FOR CALCULATING THE FRACTIONAL EXPOSURE OF PHOTOGRAPHIC MATERIAL

CROSS REFERENCE TO RELATED APPLICATIONS

Reference is made to commonly assigned, co-pending U.S. patent application Ser. No. [Attorney Docket No. 82,453/MSS] entitled A METHOD AND SYSTEM FOR PROCESSING OF PHOTOGRAPHIC MATERIALS by Christopher B. Rider et al., filed concurrently herewith.

FIELD OF THE INVENTION

The present invention relates to a method and system for calculating the fractional exposure of photographic material. The invention also relates to a method of controlling chemical replenishment and determination of a suitable rate of replenishment to be used in photographic processing.

BACKGROUND OF THE INVENTION

During the developer stage of photographic processing, a developing agent is used to reduce silver grains that contain a latent image to metallic silver in the emulsion layer of a photographic material being processed. The developer solution is therefore used at a rate that depends upon the image area or exposure of the processed film. The development reaction also results in the creation of unwanted by-products.

The quality of the final image exposed onto the film is critically dependent upon the state or activity of the developer solution. It is therefore important not only to replenish the developer solution to replace the developing agent and flush out the by-products, but also to achieve the correct level of replenishment for the film processed. The developer needs to be replenished at a rate based upon the amount of regeneration required. Therefore the rate of replenishment needs to reflect the amount of developed silver.

Developer solutions are also prone to aerial oxidation and an appropriate addition to the rate of replenishment needs to be made based upon the amount of time the solution has been left idle and exposed to air between processed film areas.

While most processors replenish the developer to account for both aerial oxidation and the area of film processed, usually the film exposure is not known. A user must therefore correctly set the appropriate replenishment rate for the expected average exposure of their processed film according to the manufacturer's recommendations. In practice, the film manufacturer would be likely to have a recommendation for operation at, say, three levels of exposure covering the likely range over which the film is used. The user selects and applies the developer replenishment rate most appropriate to their particular situation.

In some instances and for some developer and replenisher combinations, solution activity can be maintained by supplying a very high rate of replenishment so that the tank solution contains low levels of development by-products. However, for some replenisher solutions, over-replenishment can be equally detrimental to image quality leading to over-activity. Furthermore, cost and environmental impacts lead a drive to using the minimum required replenishment rate. High activity solutions have even been specifically designed as replenishers for low replenishment rate usage and therefore make the correct choice of replenishment rate settings critical.

A solution to this problem is to replenish the developer such that a first part of the volume of replenisher supplied compensates for changes in activity due to time-dependent processes, such as aerial oxidation and a second part compensates for changes due to development processes.

In the graphic arts industry where high-contrast black and white images are produced, it is known that replenishment rate can be linked to the total amount of black area on developed images to provide effective control of developer activity. The black area is a direct result of the exposure given to the film during the creation of an image on the film and this process of controlling developer replenishment according to the exposure given to the film is known as exposure dependent replenishment (EDR). To use EDR, the fractional exposure of a film being processed is required. In a high contrast material, this is equivalent to the fractional area of the material fully exposed to light, or more generally it is the fraction of the mass of silver ions developed to silver metal.

A number of methods to determine the exposure given to a photographic material so that EDR can be used to control the developer activity and replenishment rate have been proposed. For example, in imagesetting systems, where a direct link exists between the processor and the imagesetter, information such as the integrated total exposure, is transmitted from the imagesetter to the processor and used to control the developer replenishment rate. An example of such a system is described in, for example, United Kingdom Patent Number GB 2,111,726A. A disadvantage of this approach is that custom software must be developed for every different exposing device to which the processor may be connected. This is also clearly of no use to an off-line processor i.e., a processor that is not linked to an exposing device.

Another approach used in the graphic arts industry to obtain exposure information for EDR is to use a post-process scanner to measure the black area on the film. This technique is disclosed in, for example, U.S. Pat. No. 4,314,753 in the name of Pako Corporation. This approach however suffers from the extra cost needed to build a film scanner onto the processor drier. If a high degree of measurement accuracy is required, the extra cost can be substantial.

If the fractional exposure of a film is not supplied or cannot be measured, an alternative method is to directly measure and maintain the developer activity, for example by electrochemical methods. This technique is disclosed in, for example, U.S. Pat. No. 3,970,475. There are drawbacks to these methods since electrochemical sensors require calibration and are prone to drift or fouling. In addition, titration methods to provide and control the required amount of replenisher are difficult to automate into a replenishment system.

Another approach used in the graphic arts industry to obtain exposure information for EDR is to perform a mass balance for the silver entering the fixing stage. This technique is disclosed in, for example, U.S. Pat. No. 3,828,172 in the name of Schickler et al. It relies on the principle that if all the silver that has entered the fixing stage of the processor can be accounted for and if the original total silver content of the processed film is known then the discrepancy in these two figures can be attributed to image area. However, a problem with the technique disclosed in U.S. Pat. No. 3,828,172 is that the use of a silver ion sensor is required to determine the total silver content of the fixing stage, which is one of the key terms in the calculation discussed therein. Thus, the apparatus required to operate the method described is expensive in that a silver sensor must be supplied and kept calibrated in customer usage. In addition, the silver sensor introduces problems of robustness, drift, accuracy and calibration to the determination of the fixing stage silver content and/or silver concentration.

Problem to be Solved by the Invention

A method of and a system for calculating the fractional exposure of photographic material and a corresponding rate of replenishment to be used in photographic processing is required that overcomes all the problems described above. In particular, a method and system of photographic processing is required that overcomes all the previously mentioned disadvantages, providing a method requiring minimal additional cost and sufficient accuracy.

SUMMARY OF INVENTION

According to a first aspect of the present invention, there is provided a method of calculating the fractional exposure of photographic material. The exposed material is processed in a processing system having a developing stage, a fixing stage and an in-line silver recovery unit associated with the fixing stage. The process comprises determining the mass of silver recovered by the in-line silver recovery unit during a period of operation of the method; calculating a first estimate for the fractional exposure of the photographic material in dependence on the determined mass of silver; and using the first estimate as an input to an iterative process to obtain a subsequent estimate for the fractional exposure ($\theta$) of the photographic material.

Preferably, the iterative process comprises the steps of calculating an estimate for the silver leaving the fixing stage in processing fluid during the period of operation in dependence on the last calculated estimate for the fractional exposure; and calculating a subsequent estimate for the fractional exposure of the photographic material using the estimate obtained for the silver leaving the fixing stage in processing fluid in the estimate calculation step.

Preferably, the first estimate for the fractional exposure of the photographic material is obtained by using the following equation:

$$1-\theta \approx \left(\frac{Ag_{REC}}{\sum \text{Area} \times \text{Coated Weight}}\right)$$

in which, $Ag_{REC}$ is the mass of silver recovered during the period of operation;

Area is the area of each piece of photographic material processed during the period of operation; and Coated Weight is the mass of silver per unit area in each piece of photographic material processed during the period of operation.

Preferably, the subsequent estimate for the fractional exposure of the photographic material is obtained by using the following equation:

$$1-\theta = \left(\frac{\left(Ag_{EFF}\left(1+\frac{R_{C/O}}{\eta_1 R_{FIX}}\right)+Ag_{REC}\right)}{\sum \text{Area} \times \text{Coated Weight}}\right)$$

in which, $Ag_{REC}$ is the mass of silver recovered during the period of operation; $Ag_{EFF}$ is the mass of silver associated with fixing solution which passes out of the fixing stage other than by carry out with processed material during the period of operation; $R_{FIX}$ is the fixer replenishment rate; $R_{C/O}$ is the rate of carry-out of solution by the processed material from the fixing stage; and $\eta_1$ is an efficiency factor for fixing which is both fixing time and silver concentration dependent. The estimate for the silver lost to effluent during the period of operation is obtained by using the following equation:

$$Ag_{EFF} \approx \frac{V_{EFF}}{2}\left([Ag_{INITIAL}] + \frac{\left(V_{TANK}[Ag_{INITIAL}] + \theta\eta_2 \sum \text{Area} \times \text{Coated Weight} - Ag_{PROC}\right)}{V_{TANK}+V_{EFF}}\right)$$

in which, $V_{EFF}$ is the volume of fixer effluent generated; $V_{TANK}$ is the volume of the fixing stage including the silver recovery unit; $[Ag_{INITIAL}]$ is the silver concentration of the fixing stage including the silver recovery unit at the start of the period of operation; $Ag_{PROC}$ is the mass of silver removed in the time between the end of processing of a first area of photographic material and the start of processing of a final area of photographic material during the period of operation; and $\eta_2$ is an efficiency factor for fixing which is both fixing time and silver concentration dependent.

According to a second aspect of the present invention, there is provided a method of control for use in a photographic processing system having processing stages including a developing stage, a fixing stage and an in-line silver recovery unit associated with the fixing stage. The steps of the method include: calculating the fractional exposure of the photographic material in accordance with the method of the first aspect of the present invention; and using an exposure-dependent algorithm to determine an appropriate replenishment rate for at least one of the processing stages in dependence on the calculated fractional exposure.

According to a third aspect of the present invention, there is provided a photographic processing system, comprising a fixing stage to receive and fix developed black and white photographic material; an in-line silver recovery unit associated with the fixing stage to recover silver from processing solution in the fixing stage; and control means to determine the mass of silver recovered by the in-line silver recovery unit and calculate the fractional exposure of the processed photographic material. The control means is arranged to iteratively calculate the fractional exposure of the photographic material in dependence on the determined mass of silver.

Preferably, the system further comprises a developing stage to develop photographic material and provide the material to the fixing stage and a washing stage to receive and wash photographic material from the fixing stage.

Preferably, the control means is arranged to calculate a first estimate for the fractional exposure of the photographic material in dependence on the determined mass of silver;

calculate a corresponding estimate for the mass of silver leaving the fixing stage in processing fluid during a period of operation thereof in dependence on the first estimate for the fractional exposure; and calculate a subsequent estimate for the fractional exposure of the photographic material using the estimate calculated for the silver leaving the fixing stage in processing fluid.

Advantageous Effect of the Invention

The use of in-line electrolytic silver recovery is known in photographic systems and it enables users to:

i. reduce their fixer replenishment rates;

ii. reduce the total amount of silver passing into the wash tank and hence maintain compliance with local silver discharge codes when passing wash water directly to drain; and iii. recover valuable silver.

The invention provides a method and system that uses silver recovery units to enable simple calculation of the fractional exposure of photographic material being processed. This in turn enables control of the replenishment rate for the photographic processing system to be achieved. In particular, an iterative process is used to calculate the fractional exposure of photographic material being processed, the only required initially unknown input to the iteration being the recovered mass of silver by the silver recovery unit. Accordingly, there is no need for any complex ion sensors to determine the silver concentration of processing solution in the fixing stage (as required for example in Schickler et al). Therefore the problems of the cost of the ion sensors and the need to calibrate them are overcome.

In addition, the cost of purchasing silver recovery units is soon recovered through the cost savings achieved by recycling the recovered silver. The present invention uses information, which can be obtained from the operation of the silver recovery unit and the processing system to determine the amount of developed silver in the images and so provide the information which is necessary for control of the developer activity by EDR.

BRIEF DESCRIPTION OF THE DRAWINGS

Examples of the present invention will now be described in detail with reference to the accompanying drawings, in which.

DETAILED DESCRIPTION OF THE INVENTION

Figure 1A:
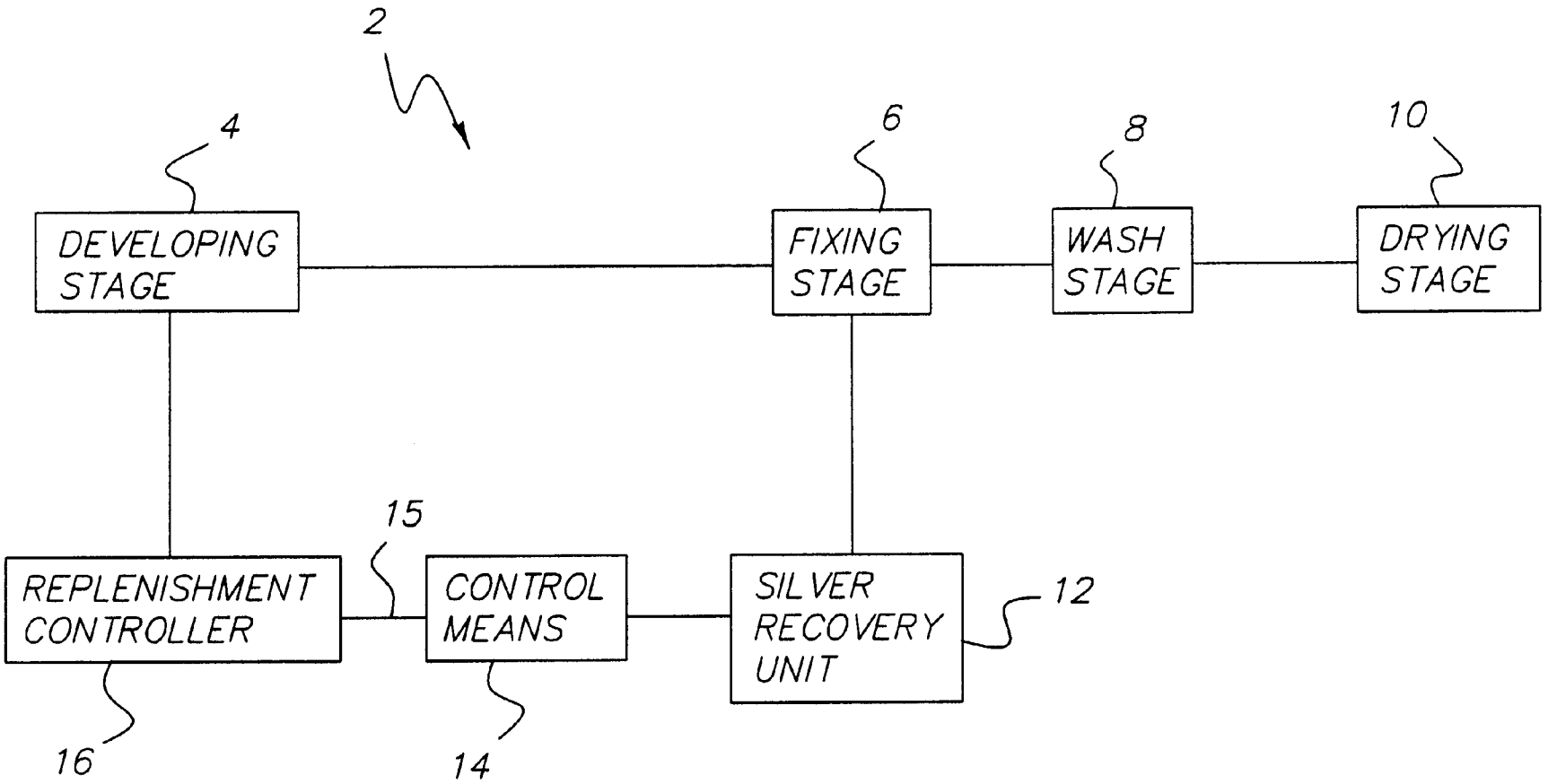
FIG. 1A shows a schematic representation of a processing system according to the present invention.

FIG. 1A shows a schematic representation of a processing system 2 according to the present invention. The system 2 has a developing stage 4 arranged to receive a photographic material to be processed through an input (not shown). The black and white photographic material may include, for example, microfilm, X-ray materials, high contrast materials, printing plates or any other light-sensitive silver containing material. The developing stage is coupled to a fixing stage 6 through which photographic material passes after it has been developed and before it is washed and dried by wash stage 8 and drying stage 10 respectively. An in line silver recovery unit 12 is provided, coupled to the fixing stage 6 to recover silver from fixer solution within the fixing stage 6. Control means 14 are provided to determine the mass of silver recovered by the in-line silver recovery unit 12. In one example, the control means includes a weighing device to weigh the silver recovery unit 12 and thereby determine the mass of silver recovered.

The control means 14 also functions to provide a control signal 15 to a replenishment controller 16 to ensure that the rate of replenishment of the developer corresponds to a required rate to achieve optimum performance of the processing system. In the example shown, the replenishment controller is arranged to control replenishment of the developer although it will be appreciated that it could also be used to control the replenishment of the fixer solution within the fixing stage 6.

As will be explained below, the control means 14 used to provide the control signal 15 to the replenishment controller 16 may be a microprocessor such as a Digital Signal Processor or any other suitable device.

Figure 1B:
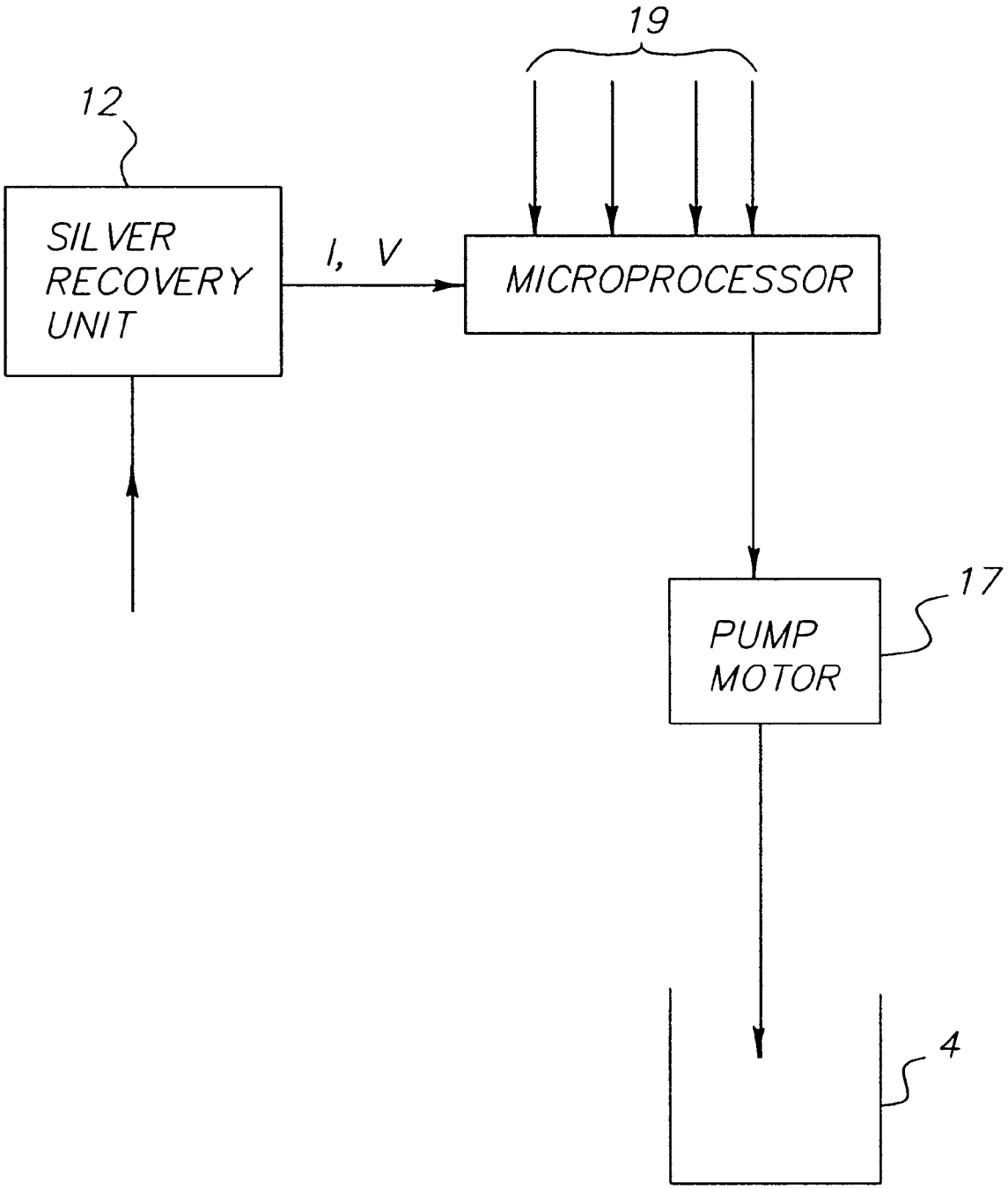
FIG. 1B shows a schematic representation of a control system for use with the processing system shown in FIG. 1A.

FIG. 1B shows a schematic representation of a control system for use with the processing system shown in FIG. 1A. The control system has a microprocessor functioning as the control means 14 of FIG. 1A. The microprocessor is arranged to receive a voltage and current signal from the in-line silver recovery unit 12. As will be explained below, the microprocessor is arranged to effect an iterative process to calculate the fractional exposure of photographic material being processed (or having been processed) and consequently determine and execute a suitable replenishment rate for the developing stage 4. In the example shown, this is done by providing a suitable drive signal to control a pump motor 17 that is configured to provide replenisher to the developing stage. To execute the iterative process to determine the fractional exposure and consequently a suitable replenishment rate a number of other inputs are provided to the microprocessor via input channels 19. These include, for example, the area of film being processed and the silver coated weight thereof.

In the case of metal exchange cartridges used as the in-line silver recovery unit, the silver mass recovered may be determined by weighing the cartridge and using the fact that the atomic weight of silver and the metal with which it is exchanging e.g. iron, are significantly different. Where electrolytic silver recovery is used, the mass of silver recovered may be determined either by weighing or more preferably by the application of Faraday's Law of electrolysis, which states that:

$$\frac{m}{M} = \frac{It}{|z|F} = \frac{Q}{|z|F}$$

where m is the mass of an element of atomic weight M liberated at an electrode of an electrolytic cell, by the passage of current I through a solution circulated through the cell in a given time t. Q is the amount of charge passed, F is Faraday's constant and $|z|$ is the number of charges on the ion reacting at the electrode.

An electrolytic silver recovery unit may be described as operating efficiently if Faraday's Law can be applied to its operation. In other words, in this example, all the charge that is passed results in the recovery of silver. Many presently available in-line silver recovery units operate efficiently some of the time, usually when the silver concentration in the fixer bath is high, but not at times when the silver concentration is low. The accuracy with which the mass of silver recovered can be computed is increased if the silver recovery unit has been operating efficiently during the whole time that electrolysis has been taking place.

A silver recovery control system has been developed which enables efficient recovery at all times, for any fixer solution type, film type, fixer temperature and film exposure or silver coated weight. The system encompasses the design of the mechanical parts and the control system and is the subject of two European Patent Applications having publication numbers EP 972,860 and EP 972,858 both in the name of the Eastman Kodak Company. An efficient silver recovery control system such as that described in the above referenced European Patent applications is preferred for operation of the present invention. Typically, in a system having an in-line silver recovery unit, film is processed during the day during which time silver concentration in the fixer bath rises. At the same time, the silver recovery unit comes into operation, having detected that the silver concentration of the fixer bath is rising. Most in-line silver recovery units are not able to remove the silver as quickly as it enters the fixer bath through film processing. Therefore, when a period of film processing ends, the silver recovery unit continues, possibly for several hours, to reduce the silver concentration until eventually it switches off, ready for the start of film processing again on the next working day. Usually, the silver concentration at the switch off point will be low and of a constant level.

For a given film throughput, if the silver concentration before and after de-silvering (or at the start and end of a monitored period) is constant, then all the silver recovered onto the cathode ($Ag_{REC}$) during that monitored period must have entered the fixer stage from the film area. In the following example, the monitored period will be referred to as the processing period from the start of film processing until the silver recovery unit is switched off. It will be appreciated that the method of the present invention is applicable during any period, at the start and end of which the silver concentration in the fixing stage is constant.

In this example, if the silver coated weight and total area of the film processed during the processing period are known then the fractional exposure of the film can be estimated as follows. The exposure of the film (in percent) is 100× the fractional exposure.

$$\text{Fractional exposure}(\theta) \approx 1 - \frac{Ag_{REC}}{\sum \text{Area} \times \text{Coated Weight}} \tag{1}$$

More generally, the Area×Coated Weight may be described as the Silver content (SC) of the photographic material (film in this case). This method therefore gives an estimate of the average fractional exposure of all the film processed during the processing period. Once the exposure of the film has been estimated, algorithms (known as exposure-dependent algorithms) exist to convert the value obtained for the fractional exposure to a desired replenishment rate. In one example of the present invention, during development, an estimated replenishment rate is used and the required replenishment rate is calculated after de-silvering and, if required, a correction is applied.

Once the exposure of the film has been estimated the developer solution can be more accurately and correctly replenished. This enables developer activity to be accurately controlled to thereby achieve optimum film performance so that less re-work of the film is required. In addition, solution usage can be reduced and also any unstable chemistry/processes can be controlled.

The present invention provides a method to achieve an even more accurate estimate of the film exposure to ensure correspondingly accurate replenishment of the developer, by making one or more modifications to equation (1) above. The modifications operate to account for further loss mechanisms for silver entering the fixing stage other than recovery onto the cathode of the silver recovery unit.

During film processing, any silver that is not electrolytically recovered is not accounted for in the mass balance equation (equation (1)) used above. For example, during replenishment of the fixer solution a significant amount of silver can leave the fixing stage in the fixer effluent. Furthermore as the film leaves the fixing stage and enters the wash stage it carries with it a portion of the fixer solution containing silver. The silver concentration in the liquid in the wash stage (usually water) is thus increased. The amount of silver lost to the wash water is typically less than that lost to effluent.

To account for these additional factors, the equation used to calculate the fractional exposure is re-written as follows:

$$\text{Fractional exposure}(\theta) = 1 - \frac{Ag_{REC} + Ag_{EFF} + Ag_{C/O}}{\sum \text{Area} \times \text{Coated Weight}} \tag{2}$$

The term $Ag_{REC}$ is the mass of silver removed through silver recovery (as in equation 1). The term $Ag_{EFF}$ is the mass of silver in the fixer effluent, and the term $Ag_{C/O}$ is the mass of silver that enters the wash stage via carry-out from the fixing stage. The sum of $Ag_{EFF}$ and $Ag_{C/O}$ represents the mass of silver that leaves the fixing stage via processing fluid.

To obtain values for these two additional terms, an iterative process is used that requires as an initial input the mass of silver recovered by the in-line silver recovery unit. This value for recovered silver is then used to obtain a first initial estimate for the fractional exposure of the photographic material. Once this has been obtained, an estimate can be obtained for the term $Ag_{EFF}$, which in turn enables a more accurate determination of the fractional exposure to be made. The term $Ag_{C/O}$ is calculated from a knowledge of the replenishment rate $R_{FIX}$, the carry-out rate $R_{C/O}$ and the mass of silver in the fixer effluent $Ag_{EFF}$ where it is assumed that the silver concentration in the effluent is the same as the carry-out. In other words, $$Ag_{EFF} + Ag_{C/O} = Ag_{EFF}\left[1 + \frac{R_{C/O}}{\eta_1 R_{FIX}}\right]$$

The iteration may be made with the following two equations:

$$1 - \theta = \left(\frac{\left(Ag_{EFF}\left(1 + \frac{R_{C/O}}{\eta_1 R_{FIX}}\right) + Ag_{REC}\right)}{\sum \text{Area} \times \text{Coated Weight}}\right) \tag{3}$$

$$Ag_{EFF} \approx \frac{V_{EFF}}{2}\left([Ag_{INITIAL}] + \frac{\left(V_{TANK}[Ag_{INITIAL}] + \theta\eta_2 \sum \text{Area} \times \text{Coated Weight} - Ag_{PROC}\right)}{V_{TANK} + V_{EFF}}\right) \tag{4}$$

$Ag_{REC}$ is the mass of silver recovered (electrolytically in this case) during the period of operation of the method. $Ag_{EFF}$ is the mass of silver in the fixer effluent, or in other words the mass of silver associated with fixing solution which passes out of the fixing stage other than by carry out with processed material during the period of operation. $R_{FIX}$ is the fixer replenishment rate and $R_{C/O}$ is the rate of carry-out of solution by the processed material from the fixing stage. $\eta_1$ and $\eta_2$ are efficiency factors for fixing which are both fixing time and silver concentration dependent.

For equation (4), $V_{EFF}$ is the volume of fixer effluent generated. $V_{TANK}$ is the volume of the fixing stage (including the silver recovery unit). The term $[Ag_{INITIAL}]$ is the silver concentration at the start of the operation of the method and $Ag_{PROC}$ is a correction term representing the amount of silver removed in the time between the end of the first piece of film having been processed and the start of the last piece of film.

In the first instance, equation (3) is used with just the recovered silver term ($Ag_{REC}$) obtained from the mass of the silver recovery unit to establish an initial estimate for the exposure i.e., $Ag_{EFF}$ is initially set to zero. This initial value for the exposure estimate, obtained from equation (3), is then used to obtain a first estimate for the value of $Ag_{EFF}$ from equation (4) since all other terms in equation (4) are known. The value for $Ag_{EFF}$ is then reintroduced to equation (3) to improve the estimate of the film exposure. The process is iterated and the estimated exposure asymptotically approaches the correct exposure value. Five iterations are sufficient to give a relatively unchanging exposure estimate, which can then be used to calculate a desired fixer, developer or wash replenishment rate. In some situations, sufficient accuracy is obtained after only one cycle of the iteration.

Thus, this method is more accurate than that described above using equation (1) because more of the silver in the system at any time is accounted for. In addition, this method provides more accurate results than those obtainable using the method disclosed in U.S. Pat. No. 3,828,172 (Schickler et al).

It will be appreciated that the equations (3) and (4) above are merely examples of possible iterative equations to be used in the method of the present invention. Different equations could also be used in dependence on the level of accuracy and/or the actual processing system (and volume thereof) used. For example, if the volume of processing fluid carried out of the fixing stage is very small compared to the volume of the fixing stage, the term representing $Ag_{C/O}$ could be neglected from the equation. Similarly, in the equations above the term for the volume of fixing solution lost to evaporation is not accounted for due to its relative small size. In other words, the relative size of a term and the accuracy of result required, determines whether or not it necessary to include it in the iteration.

One method of improving the estimate for the term $Ag_{EFF}$ referred to in equation (2) above is with the use of modelling where the silver concentration in the processing tank during the period of operation as a function of time is determined on completion of the period of operation. Data for the modelling calculations are stored during the period of operation in an associated memory. These data include the input and the output times and the area of each particular piece of film. The information also includes parameters such as the mass of the silver recovery unit before and after the time period so that the mass of silver recovered during the processing of any particular piece of film can be calculated.

As will be explained below, once the period of operation is over, working backwards to when the first piece of film entered the processor, the variation of silver concentration in the fixer with respect to time can be modelled. This enables the term $Ag_{EFF}$ to be estimated more accurately and thus the fractional exposure and optimum replenishment rates to be determined. The method assumes an average exposure has been used throughout.

Figure 2:
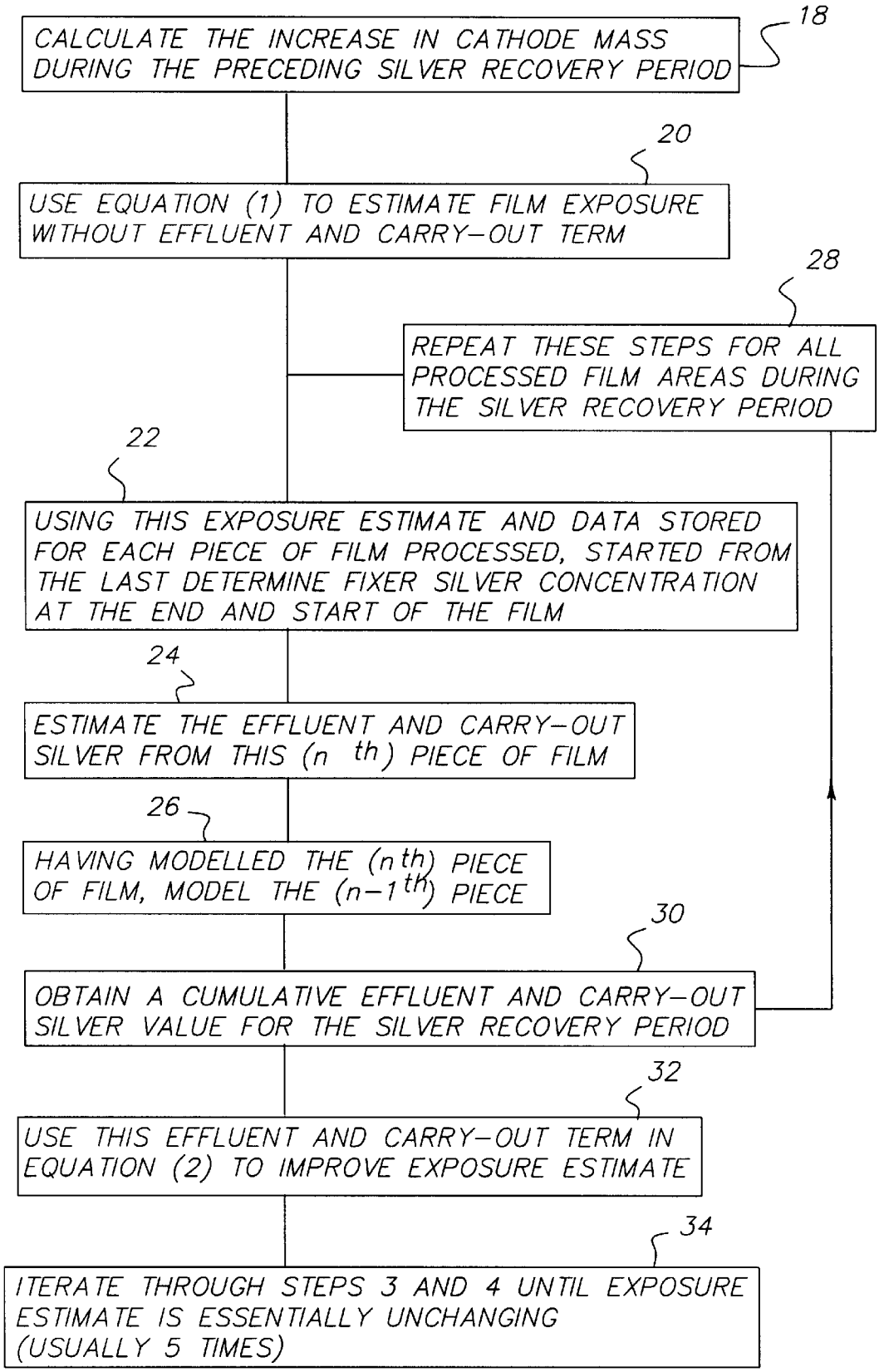
FIG. 2 shows a flow chart of the steps in a method according to one example of the present invention.

FIG. 2 shows a flow chart of the steps used to obtain a model of the variation of silver concentration in the fixing stage with respect to time to enable a more accurate estimate of $Ag_{EFF}$ to be obtained. At step 18, at the end of the silver recovery period, the change in mass of the in-line silver recovery unit is determined. This value is then used in equation (1) above at step 20 to obtain an initial estimate for the average fractional exposure of all the film processed since the end of the previous silver recovery period. At step 22, this value for the estimated fractional exposure is used together with information stored during the processing of each piece of film, to determine the fixing bath silver concentration at various times during the processing cycle. At step 24, the value for the fixing bath silver concentration is then used to estimate $Ag_{EFF}$ for each piece of film during the silver recovery period. As explained above, the value $Ag_{EFF}$ can be used to obtain an approximation for the mass of silver $Ag_{C/O}$ in the carry out from the fixing stage. At steps 26 and 28, this process is repeated for each piece of film processed since the end of the previous silver recovery period, so that at step 30 a cumulative value for $Ag_{EFF}$ (and also $Ag_{C/O}$) can be determined. At step 32, the cumulative values determined at step 30 are re-used in equation 2 to obtain an improved estimate for the fractional exposure. After approximately five iterations of this cycle, the value for the fractional exposure is substantially constant and can be used to determine an appropriate replenishment rate for the system. With each cycle of the iteration the estimate obtained is more accurate.

Figure 3:
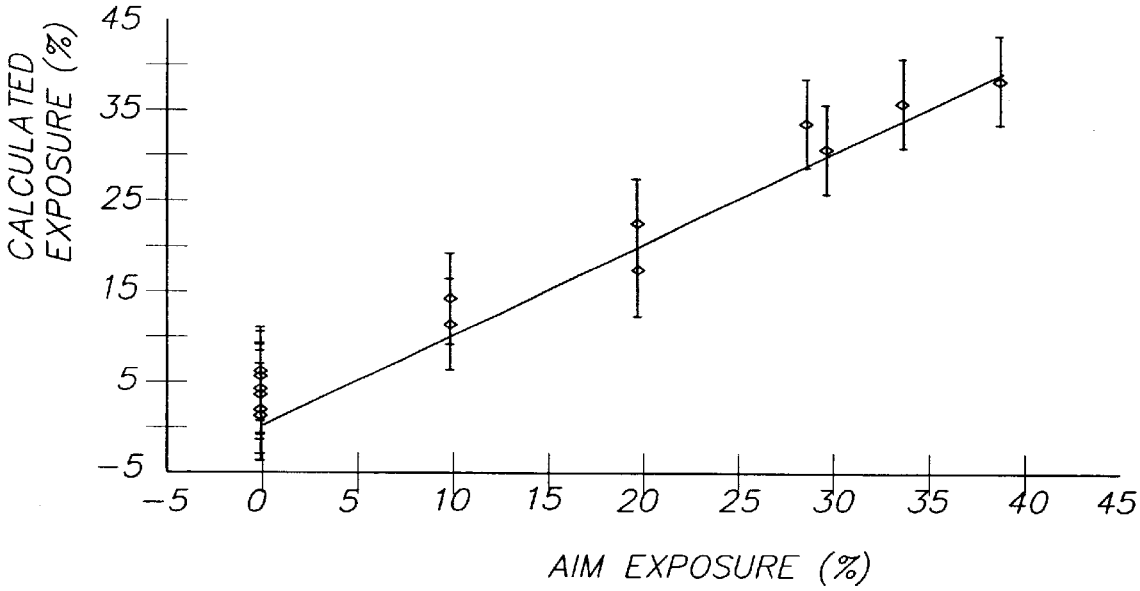
FIG. 3 shows a graph of estimated exposure from silver recovery using the method shown in FIG. 2 against the known exposure given to the film.

FIG. 3 shows a graph of results obtained using this modelling during the seasoning of a processor at 1 roll/day with GLE 2639 but random throughput and exposure. The graph plots the estimated exposure from silver recovery against the known exposure given to the film. It can be seen that in every instance the estimate is within 10% accuracy of the actual exposure. Furthermore, in all but one instance the estimate is within an accuracy of 5% as shown by the error bars on the data.

The methods described above are valid if it can be assumed that the silver concentration before and after the monitored period of operation is substantially constant. For systems such as those described in European Patent Applications having publication numbers EP 972,860 and EP 972,858 the methods are therefore preferably usable after the de-silvering process has finished. An average replenishment rate based upon previous exposure estimates must therefore be applied during processing until the figure can be corrected in dependence on a calculated value for the fractional exposure.

In other words, the control of developer replenishment must be achieved by using an average historical value for the fractional exposure during film processing and by making a later correction based on the actual fractional exposure (calculated as described above) during the electrolysis period.

To estimate the exposure of processed film at any instant after the processing period, i.e., with the processor in standby but with silver recovery still occurring, it is necessary to have a means of estimating silver concentrations in the fixer during this recovery period. The estimate for the fractional exposure in this case is obtainable using the following equation:

$$\text{Fractional Exposure}(\theta) = 1 - \frac{\Delta[Ag]V_{TANK} + Ag_{REC} + Ag_{EFF} + Ag_{C/O}}{\sum \text{Area} \times \text{Coated Weight}} \quad (5)$$

This is the same as equation (2), above, except for the addition of the term $\Delta[Ag]V_{TANK}$, which is the increase in fixer silver as a result of increased silver concentration in the fixing stage due to film processing. In equation 2 the assumptions made about operation of the processing system meant that $\Delta[Ag]$ was zero.

The use of silver concentration estimates is an extension of the modelling described above. If, after silver recovery, a profile of the silver concentration during the recovery operation and film processing period can be obtained then the calculation can be made more responsive. The silver concentrations in the fixing stage that are calculated on, say, processing day 1 are tabulated and stored in a look-up-table LUT against the voltage across the cell (for a given current) to which they correspond. There is a singular relationship between cell voltage at constant current and silver concentration for a given set of conditions, such as fixer temperature, flow rate of fixer through the cell and composition of the fixer solution. During the initial day of operation no historical information would exist in a LUT and therefore this method cannot be applied.

Furthermore the factors that affect the voltage other than silver concentration are either fixed such as solution temperature and flow rate or vary at a very slow rate, e.g. thiosulphate concentration, compared to that at which silver is removed. In this way, the data recorded on processing day 1 can be used as a way of estimating the silver concentration during processing on day 2. The estimate is made by comparing instantaneous voltages recorded on day 2 with the values in the LUT of silver concentration versus voltage from day 1. Any parameter affecting cell voltage or current and which exhibits significant variation during a period of operation of the method is typically stored in the LUT. These parameters in combination define the operating parameters of the cell.

Using this method the information necessary to estimate the exposure is available to the control system within minutes of the film leaving the fixer bath.

The replenishment of the developer can therefore be made more responsive than the previously described methods.

The values in the LUT are then updated after the de-silvering period of day 2 so that these values follow the behaviour of the fixer chemistry.

Figure 4:
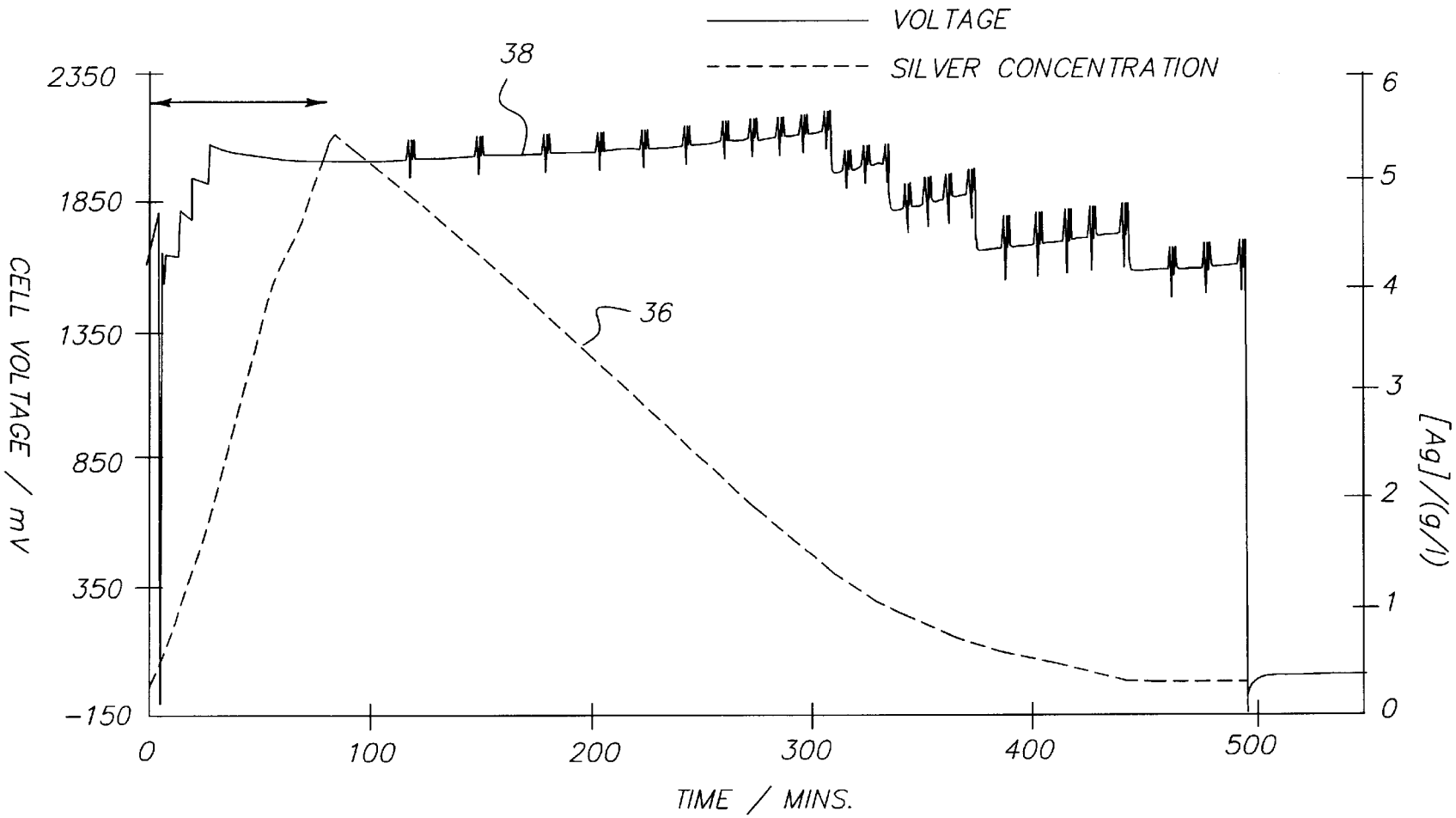
FIG. 4 shows graphs of silver concentration and cell voltage against time during a silver recovery period.

FIG. 4 shows graphs of fixing stage silver concentration (36) and cell voltage (38) during a silver recovery period (in this case a day's operation of the silver recovery unit). A continuous area of unexposed film is processed at the start of the recorded data for a period of approximately 90 minutes. During this time the silver recovery unit detects the rising silver concentration and begins recovering silver from the fixer solution. As the film is processed the silver concentration rises in this case and the voltage recorded by the silver recovery unit (for a given current) falls. As the silver recovery unit detects and monitors this falling voltage as an indicator of the increasing silver concentration the silver recovery current is increased through a series of banded levels. This can be seen in the data by the step changes in voltage during the first 30 minutes.

Once at the highest current band of 4 Amps (after approximately 30 minutes) the voltage falls while the remainder of the film is processed and then starts to rise again (>90 mins) as silver recovery slowly lowers the silver concentration. As the voltage rises the recovery system records periodic check measurements so as to determine when the concentration has become so low as to require the recovery current to be reduced. Eventually having reduced the silver concentration to a low level the control system turns off the recovery current from the lowest band.

Figure 5:
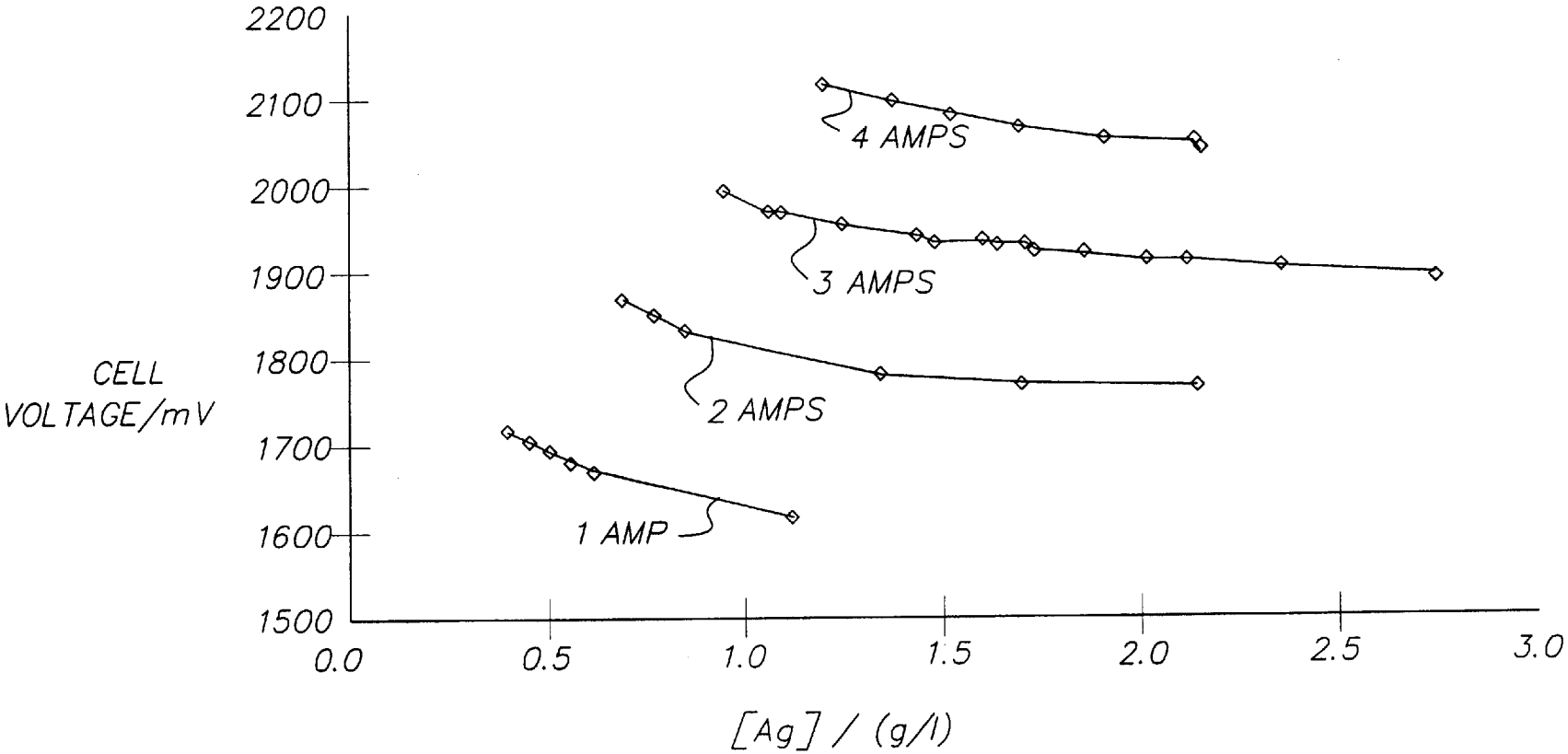
FIG. 5 shows a number of graphs of voltages across an electrolytic cell and silver concentration in the fixing stage of a processing system according to the present invention; and, FIG. 6 shows a graph of silver concentration against time obtained using a processing system according to the present invention.

FIG. 5 shows a graphical representation of the tabulated LUT data, i.e., the relationship between cell voltage (at a particular current) and fixer silver concentration during the silver recovery process according to the present invention. The different sections of the line on the graph represent different constant current bands used by the control system. To pass a higher constant current through a given solution it is necessary for the voltage across the cell to be increased.

Figure 6:
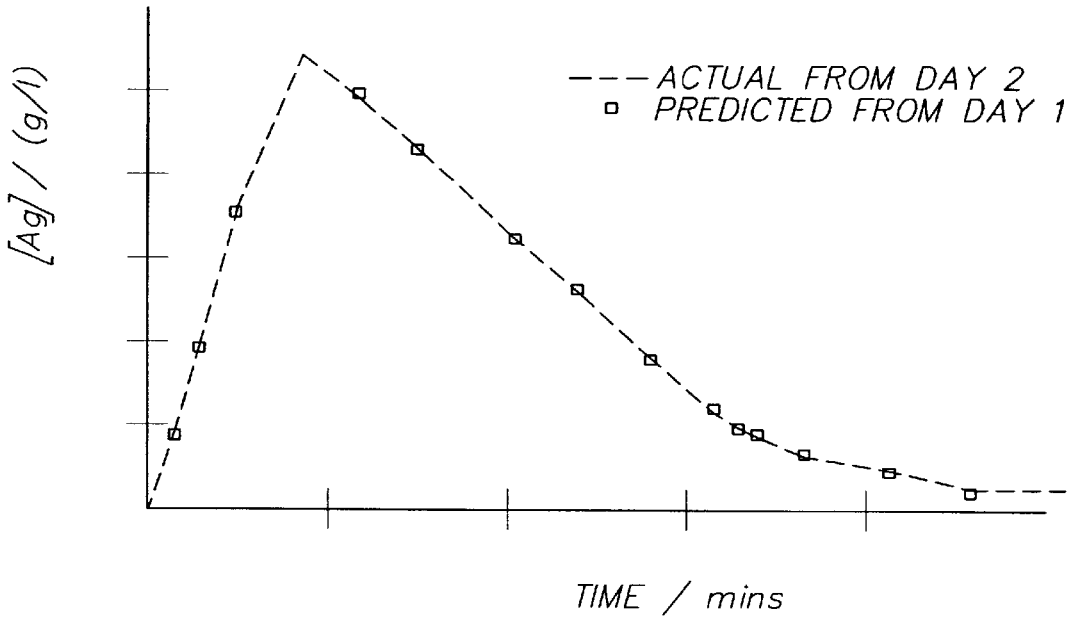

FIG. 6 shows a graph of silver concentration against time obtained using a processing system according to the present invention. The dashed line shows the actual silver concentration with time profile on the second day as measured from analytical samples. The data markers represent the predicted silver concentration for the second day using the method described above. These data were calculated from the voltages recorded on the second day and the LUT of estimated silver concentration versus voltage created on the first day of processing. In other words the LUT from the first day accurately predicts the silver concentrations for the second day.

Where extra film throughput causes the control system to reach a current level not previously used or if the chemistry is 'changed' at any point then all the stored values in the LUT must be cleared. This could effectively be the case for example if the solution had been unused for a long period and had suffered aerial oxidation.

Examples of other exposure-dependent processes are bleaching, fixing (in black and white systems) and washing (removal of image-dependent by-products). Once exposure has been determined by the techniques explained above, exposure dependent algorithms may be used to replenish each of the bleaching, fixing and wash stages of photographic processing.

What is claimed is:

1. A method of calculating the fractional exposure of developed black and white photographic material, the developed material being processed in a processing system having a fixing stage and an in-line silver recovery unit associated with the fixing stage, comprising the steps of:

(a) determining the mass of silver recovered by the in-line silver recovery unit during a period of operation of the method;

(b) calculating a first estimate for the fractional exposure of the photographic material in dependence on the determined mass of silver; and (c) using said first estimate as an input to an iterative process, to calculate a subsequent estimate for the fractional exposure (θ) of the photographic material.

2. A method according to claim 1, in which the iterative process is employed at least once and comprises the steps of:

(d) calculating an estimate for the silver leaving the fixing stage in processing fluid during said period of operation in dependence on the last calculated estimate for the fractional exposure; and, (e) calculating a subsequent estimate for the fractional exposure of the photographic material using the estimate for the silver leaving the fixing stage in processing fluid obtained in step (d).

3. A method according to claim 1, in which the first estimate for the fractional exposure of the photographic material is obtained by using the following equation:

$$1-\theta \approx \left(\frac{Ag_{REC}}{\sum \text{Area} \times \text{Coated Weight}}\right)$$

in which, $Ag_{REC}$ is the mass of silver recovered during the period of operation;

Area is the area of each piece of photographic material processed during the period of operation; and Coated Weight is the mass of silver per unit area in each piece of photographic material processed during the period of operation.

4. A method according to claim 2, in which the subsequent estimate for the fractional exposure of the photographic material is obtained by using the following equation:

$$1-\theta = \left(\frac{\left(Ag_{EFF}\left(1+\frac{R_{C/O}}{\eta_1 R_{FIX}}\right)+Ag_{REC}\right)}{\sum \text{Area} \times \text{Coated Weight}}\right)$$

in which, $Ag_{REC}$ is the mass of silver recovered during the period of operation;

$Ag_{EFF}$ is the mass of silver associated with fixing solution which passes out of the fixing stage other than by carry out with processed material during the period of operation;

$R_{FIX}$ is the fixer replenishment rate;

$R_{C/O}$ is the rate of carry-out of solution by the processed material from the fixing stage; and $\eta_1$ is an efficiency factor for fixing which is both fixing time and silver concentration dependent, and in which the estimate for the silver lost to effluent during said period of operation is obtained by using the following equation:

$$Ag_{EFF} \approx \frac{V_{EFF}}{2}\left([Ag_{INITIAL}] + \frac{\left(V_{TANK}[Ag_{INITIAL}] + \theta\eta_2 \sum \text{Area} \times \text{Coated Weight} - Ag_{PROC}\right)}{V_{TANK}+V_{EFF}}\right)$$

in which, $V_{EFF}$ is the volume of fixer effluent generated;

$V_{TANK}$ is, the volume of the fixing stage including the silver recovery unit;

$[Ag_{INITIAL}]$ is the silver concentration of the fixing stage including the silver recovery unit at the start of the period of operation;

$Ag_{PROC}$ is the mass of silver removed in the time between the end of processing of a first area of photographic material and the start of processing of a final area of photographic material during the period of operation; and $\eta_2$ is an efficiency factor for fixing which is both fixing time and silver concentration dependent.

5. A method according to claim 4, in which the value of silver concentration during the period of operation is modelled after said period of operation to obtain an estimate for the value of $Ag_{EFF}$.

6. A method according to claim 5, in which a cumulative value of $Ag_{EFF}$ is used to determine the fractional exposure of the photographic material, the cumulative value being determined as a sum of the values of $Ag_{EFF}$ for each piece of photographic material processed during said period of operation.

7. A method according to claim 1, in which the silver recovery unit is electrolytic and in which the value of the silver concentration in the fixing stage during the period of operation is modelled to obtain a relationship between one or more of the operating parameter of the silver recovery unit and the silver concentration in the fixing stage, the relationship being used to determine the silver concentration in the fixing stage during a subsequent period of operation, the silver concentration being used to determine the fractional exposure during said subsequent period of operation.

8. A method according to claims 2, in which the silver recovery unit is electrolytic and in which the value of the silver concentration in the fixing stage during the period of operation is modelled to obtain a relationship between one or more of the operating parameter of the silver recovery unit and the silver concentration in the fixing stage, the relationship being used to determine the silver concentration in the fixing stage during a subsequent period of operation, the silver concentration being used to determine the fractional exposure during said subsequent period of operation.

9. A method according to claim 3, in which the silver recovery unit is electrolytic and in which the value of the silver concentration in the fixing stage during the period of operation is modelled to obtain a relationship between one or more of the operating parameter of the silver recovery unit and the silver concentration in the fixing stage, the relationship being used to determine the silver concentration in the fixing stage during a subsequent period of operation, the silver concentration being used to determine the fractional exposure during said subsequent period of operation.

10. A method according to claim 4, in which the silver recovery unit is electrolytic and in which the value of the silver concentration in the fixing stage during the period of operation is modelled to obtain a relationship between one or more of the operating parameter of the silver recovery unit and the silver concentration in the fixing stage, the relationship being used to determine the silver concentration in the fixing stage during a subsequent period of operation, the silver concentration being used to determine the fractional exposure during said subsequent period of operation.

11. A method according to claim 7, in which during said subsequent period of operation the value of the silver concentration in the fixing stage is modelled to update the relationship between the one or more operating parameters and the silver concentration of the fixing stage.

12. A method according to claim 7, in which the fractional exposure (θ) is calculated in dependence on the following equation:

$$\theta = 1 - \frac{\Delta[Ag]V_{TANK} + Ag_{REC} + Ag_{EFF}\left(1+\frac{R_{C/O}}{\eta_1 R_{FIX}}\right)}{\sum \text{Area} \times \text{Coated Weight}}$$

in which, Δ[Ag] is the increase in silver concentration in the fixing stage during the period of operation as a result of film processing.

13. A method according to claim 11, in which the fractional exposure (θ) is calculated in dependence on the following equation:

$$\theta = 1 - \frac{\Delta[Ag]V_{TANK} + Ag_{REC} + Ag_{EFF}\left(1+\frac{R_{C/O}}{\eta_1 R_{FIX}}\right)}{\sum \text{Area} \times \text{Coated Weight}}$$

in which, Δ[Ag] is the increase in silver concentration in the fixing stage during the period of operation as a result of film processing.

14. A method of control for use in a photographic processing system having processing stages including a developing stage, a fixing stage and an in-line silver recovery unit associated with the fixing stage, comprising the steps of:

calculating the fractional exposure of the photographic material in accordance with the method of claim 1; and using an exposure-dependent algorithm to determine an appropriate replenishment rate for at least one of the processing stages in dependence on the calculated fractional exposure.

* * * * *